US007550658B2

(12) United States Patent
Suzuki et al.

(10) Patent No.: US 7,550,658 B2
(45) Date of Patent: Jun. 23, 2009

(54) KEYBOARD MUSICAL INSTRUMENT WITH FALLBOARD LOCATED AT PROPER POSITION AND ROTARY CONNECTOR USED FOR FALLBOARD

(75) Inventors: Takamitsu Suzuki, Milton Keynes (GB); Akira Nakamura, Hamamatsu (JP); Akio Suzuki, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/603,412

(22) Filed: Nov. 21, 2006

(65) Prior Publication Data

US 2007/0157794 A1 Jul. 12, 2007

(30) Foreign Application Priority Data

Jan. 12, 2006 (JP) ..... 2006-004811

(51) Int. Cl.
*G10C 3/02* (2006.01)

(52) U.S. Cl. ..... 84/179; 84/178; 16/235; 16/236; 16/237; 16/242

(58) Field of Classification Search ..... 84/178, 84/179; 16/235–238, 242
See application file for complete search history.

(56) References Cited

U.S. PATENT DOCUMENTS 1,462,726 A * 7/1923 Voss et al. ..... 160/77
6,983,514 B2 * 1/2006 Lu et al. ..... 16/342
7,012,179 B2 * 3/2006 Shimano ..... 84/179
7,162,774 B1 * 1/2007 Von Resch et al. ..... 16/236
7,231,691 B1 * 6/2007 Domenig et al. ..... 16/236
7,240,400 B2 * 7/2007 Bonham ..... 16/238
7,293,329 B2 * 11/2007 Heid ..... 16/245
2002/0139236 A1 * 10/2002 Sandifer ..... 84/179
2005/0273976 A1 * 12/2005 Sarver ..... 16/242
2007/0157794 A1 * 7/2007 Suzuki et al. ..... 84/423 R

OTHER PUBLICATIONS

Basic types of wood screws, http:diydata.com/materials/screws/screws.php, viewed Jun. 2, 2008.*
Truss Head Srews, Mr. G's Fasteners, viewed Jun. 2, 2008.*
Restoration Report, 1996-2003, move hinges to align fallboard, http:/www.hpschd.nu/rst/sqpf.htm, viewed Jun. 2, 2008.*

* cited by examiner

*Primary Examiner*—Jeffrey Donels
*Assistant Examiner*—Robert W Horn
(74) *Attorney, Agent, or Firm*—Morrison & Foerster LLP

(57) ABSTRACT

A front fallboard, a rear fallboard and a hinge connected between them form in combination a fallboard assembly connected between side arms of a piano cabinet by means of a pair of rotary connectors, and each of the rotary connectors includes a front metal plate connected to the side surface of the front fallboard, a rear metal plate connected to the bottom surface of the side art defining a recess and a rotary damper; since the recess is wider than the rear metal plate already combined with the rotary damper, the rear metal plate is movable on a virtual plane defined by a fore-and-aft direction and an up-and-down direction; while a worker is seeking the optimum positions of the rotary connectors, self-tapping screws keep the rear metal plates in the recesses so that the worker drives woodscrews into the side arms through main holes or auxiliary holes.

18 Claims, 10 Drawing Sheets

KEYBOARD MUSICAL INSTRUMENT WITH FALLBOARD LOCATED AT PROPER POSITION AND ROTARY CONNECTOR USED FOR FALLBOARD

FIELD OF THE INVENTION

This invention relates to a keyboard musical instrument and, more particularly, to a keyboard musical instrument having a fallboard rotatably connected to a cabinet of the keyboard musical instrument and a rotary connector used between the fallboard and the cabinet.

DESCRIPTION OF THE RELATED ART

In the following description, term "front" is indicative of a position closer to a player, who gets ready to finger a piece of music, than a position modified with term "rear". A line drawn between a front position and a corresponding rear position extends in a "fore-and-aft direction", and a lateral direction crosses the fore-and-aft direction at right angle. An "up-and-down direction" is vertical to a plane defined by the fore-and-aft direction and the lateral direction. The "right" and "left" are determined with respect to the player who is fingering on the keyboard musical instrument. The "clockwise direction" and "counter clockwise direction" are determined on a sheet of paper where a figure or figures, to which a movable component member are drawn. "Right" and "left" are determined with respect to a player who is fingering a tune on the musical instrument.

A piano is a typical example of the keyboard musical instrument. The piano cabinet has a key bed, which horizontally projects in the frontward direction, and a keyboard is mounted on the key bed. While a pianist is playing a tune on the keyboard, a fallboard stands against the upper front board of the piano cabinet. When the pianist leaves the room, he or she covers the keyboard with the fallboard. Thus, the fallboard is changed between the open position and the closed position.

The fallboard of pianos is usually rotatably supported by the piano cabinet. In other words, a rotary connector is required for the fallboard. A typical example of the rotary connector is disclosed in Japan Patent Application laid-open No. Sho 63-41898. Since the rotary connector makes the fallboard gently landed on a key slip, which laterally extends in front of the keyboard, the prior art rotary connector is called as a "rotary damper".

The prior art rotary damper includes a cylinder, a shaft and a spring. The spring is wound on the shaft, and the shaft is rotatably accommodated in the cylinder together with the spring. A pair of prior art rotary dampers is provided between the fallboard and the piano cabinet. The cylinders are embedded in the boss portion of the fallboard, and the shafts sidewardly project from the boss portion, and the shafts are secured to the piano cabinet by means of metal sockets. The sockets are fixed to the side arms of the piano cabinet. While the pianist is changing the fallboard between the open position and the closed position, the shafts are rotated in the cylinders so that the prior art rotary dampers permit the fallboard to be rotated with respect to the piano cabinet. The shafts are grasped with the springs in the rotation from the open position to the closed position so that the pianist gently lands the fallboard on the key slip with the assistance of the prior art rotary dampers.

A problem is encountered in the prior art rotary dampers in the fitting work between the key slip and the fallboard. When the prior art rotary dampers are properly embedded in the fallboard, the front end of the fallboard is correctly overlaid on the key slip, and any step does not take place at the boundary between the key slip and the fallboard. However, errors are unavoidable in the machining work on the fallboard and key slip. Moreover, it is difficult for assembling workers to embed the cylinders in the boss portion without any tolerance. The machining errors and assembling errors result in the fallboard slightly offset from the key slip.

The prior art rotary dampers make the fitting work between the fallboard and the key slip difficult. This is because of the fact that the assembling workers can adjust the cylinders and sockets to target positions on the side surfaces of the fallboard and target positions on the side surfaces of the side arms before the embedment and fixation. In order to overcome the problem inherent in the prior art rotary dampers, the manufacturer may prepare plural sockets different in size. When a assembling worker admits the step between the fallboard and the key slip, the assembling worker replaces the sockets with other sockets different in size so as to eliminate the step from the boundary between the fallboard and the key slip. However, the preparation of plural sockets different in size is costly. Moreover, a large amount of the time and labor is consumed in the replacement with the different sized sockets.

SUMMARY OF THE INVENTION

It is therefore an important object of the present invention to provide a rotary connector provided between a fallboard and a cabinet which permits an assembling worker to adjust the fallboard to a proper position with respect to the cabinet without increase of production cost.

It is also an important object of the present invention to provide a keyboard musical instrument, which has a fallboard properly connected to a cabinet by means of the rotary connector.

In accordance with one aspect of the present invention, there is provided a rotary connector provided between a case of a musical instrument and a cover plate rotatable about an axis extending in a lateral direction of the case, and the rotary connector comprises a stationary portion connected to one of the cover plate and the case, a rotatable portion connected to the other of the cover plate and the case and rotatable with respect to the stationary portion and a position adjuster provided in association with one of the stationary portion and the rotatable portion and permitting the aforesaid one of the stationary portion and the rotatable portion to be moved to an optimum position on a virtual plane defined by an up-and-down direction and an fore-and-aft direction of the case.

In accordance with another aspect of the present invention, there is provided a musical instrument for producing tones comprising a case having a fore-and-aft direction, a lateral direction and an up-and-down direction, an array of manipulators arranged in the lateral direction for specifying a pitch of the tones and mounted on the case, a cover plate supported by the case for preventing the array of manipulators from damages and rotatable about an axis extending in the lateral direction, a tone generating system housed in the case and connected to the array of manipulators for producing the tones, and rotary connectors provided between the case and the cover plate and each including a stationary portion connected to one of the cover plate and the case, a rotatable portion connected to the other of the cover plate and the case and rotatable with respect to the stationary portion and a position adjuster provided in association with one of the stationary portion and the rotatable portion and permitting the aforesaid one of the stationary portion and the rotatable portion to be moved to an optimum position on a virtual plane defined by the up-and-down direction and the fore-and-aft direction.

BRIEF DESCRIPTION OF THE DRAWINGS

The features and advantages of the rotary connector and keyboard musical instrument will be more clearly understood from the following description taken in conjunction with the accompanying drawings, in which.

DESCRIPTION OF THE PREFERRED EMBODIMENTS

A musical instrument embodying the present invention comprises a case, an array of manipulators, a cover plate, a tone generating system and rotary connectors. The case has a flat portion, and an inner space is defined in the case. The array of manipulators is mounted on the flat portion, and the tone generating system is housed in the case. The case has a fore-and-aft direction, a lateral direction and an up-and-down direction, and the array of manipulators is arranged in the lateral direction. A player specifies the pitch of tones through the manipulators, and the tone generating system produces the tones at the specified pitch.

The cover plate is supported by said case through the rotary connectors, which are connected between the case and the cover plate, so that the cover plate is rotatable about an axis extending in the lateral direction. The array of manipulators is covered with the cover plate. When the cover plate is rotated from a closed position to an open position, the array of manipulators is exposed to a player so as to permit the player to specify the pitch. While the cover plate is resting at the closed position, the array of manipulators is prevented from damage.

Each of the rotary connectors includes a stationary portion, a rotary portion and a position adjuster. The stationary portion is connected to one of the cover plate case, and the rotatable portion is connected to the other of the cover plate and case. Since the rotatable portion is rotatable with respect to the stationary portion, the rotary connectors permit the player to rotate the cover plate about the axis.

The position adjuster is provided in association with one of the stationary portion and rotatable portion. Although the position adjuster is useless except for an assembling work on the cover plate and case, a worker properly easily assembles the cover plate with the case by virtue of the position adjuster. When the worker assembles the cover plate with the case, he or she is to locate the cover plate at an optimum position with respect to the case. If the worker fails to locate the cover plate at the optimum position, a boundary between the cover plate and the case is found to be unusual. Then, the worker moves one of the stationary and moveable portions to the optimum position on a virtual plane defined by the up-and-down direction and fore-and-aft direction. In this situation, the position adjuster makes the stationary and movable portions reusable. In other words, it is not necessary to replace the stationary portion or movable portion with new one. This is because of the fact that the position adjuster is adapted to permit the stationary portion or rotatable portion to be moved to the optimum position. Thus, the rotary connector of the present invention makes the production cost of keyboard musical instrument reduced.

First Embodiment

Figure 1:
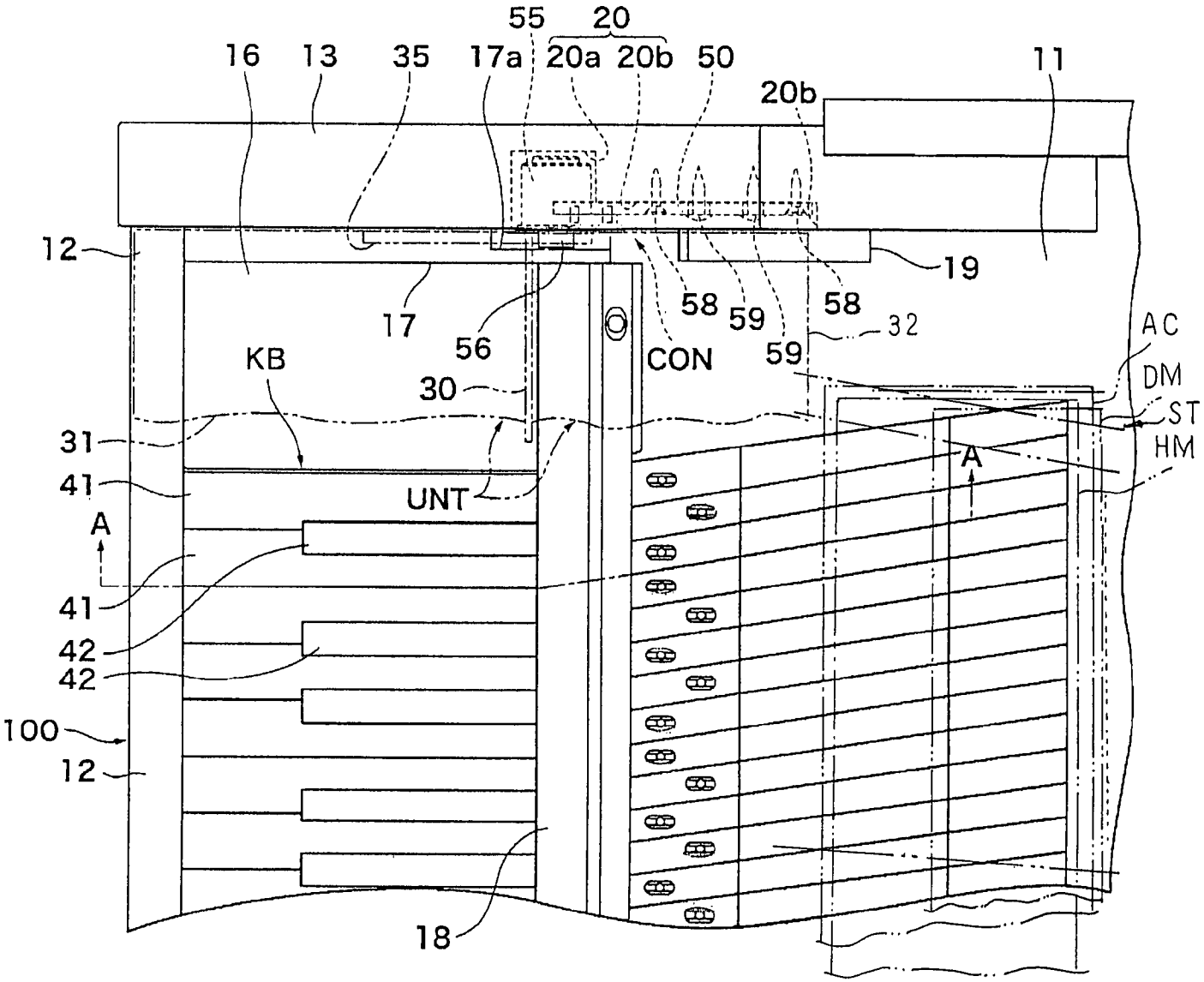
FIG. 1 is a plane view showing essential parts of a keyboard musical instrument according to the present invention.
Figure 2:
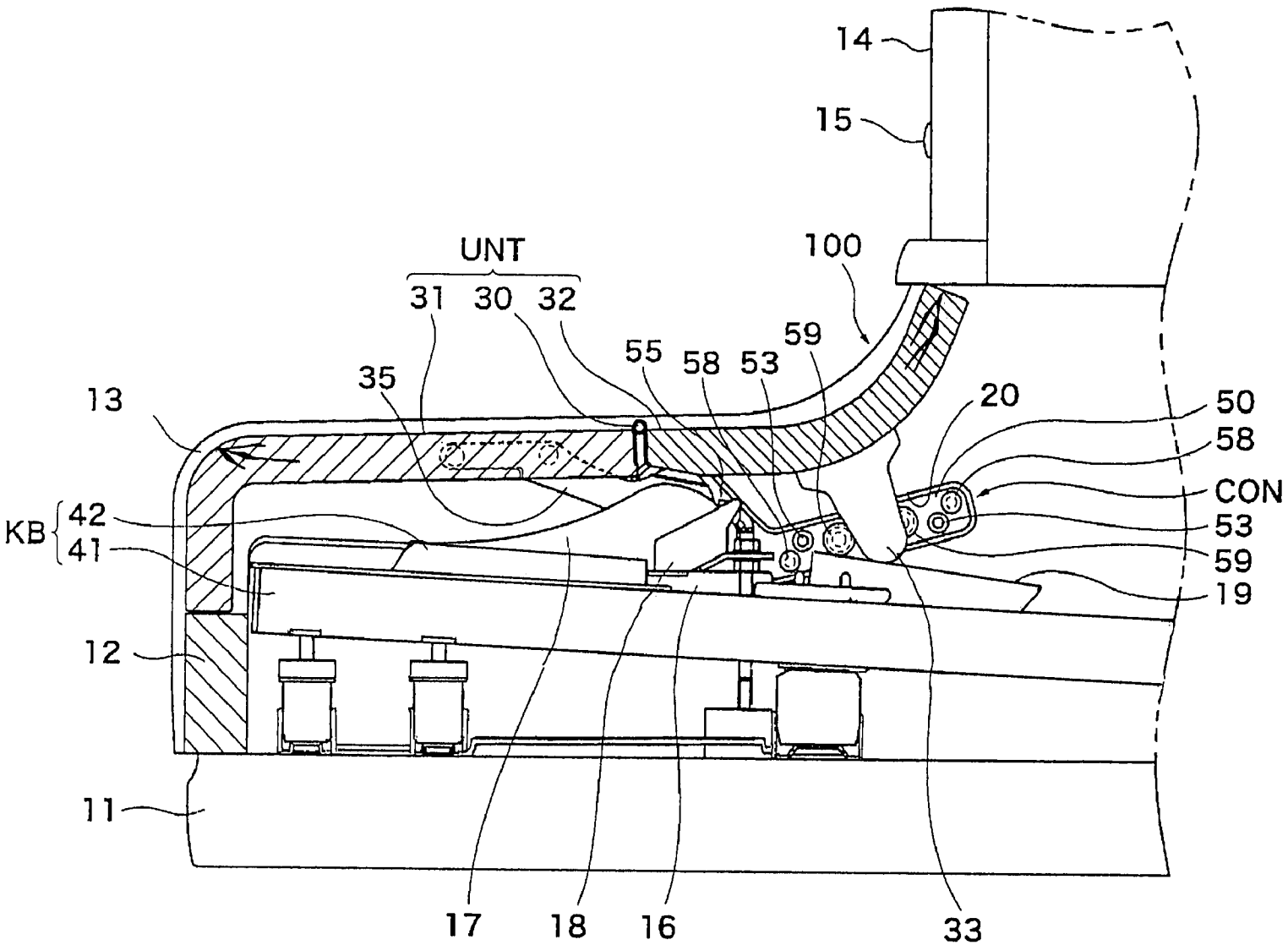
FIG. 2 is a partially cut-out side view taking along line A-A of FIG. 1 and showing the structure of the keyboard musical instrument.

Referring to FIGS. 1 and 2 of the drawings, a piano, which is categorized in an upright piano, largely comprises a keyboard KB, action units AC, hammers HM, dampers DM, strings ST, a piano cabinet 100, a fallboard assembly UNT and a pair of rotary connectors CON. The action units AC, hammers HM, dampers DM and strings ST are well know to persons skilled in the art. For this reason, the array of action units AC, array of hammers HM and array of dampers DM are indicated by phantom lines in FIG. 1, and the structure and action are not described for the sake of simplicity. Although a part of the left half of the piano is illustrated in FIG. 1, the right half is symmetrical with the left half.

The piano cabinet 100 is supported by leg posts (not shown), and defines an inner space open to the outside through an upper opening. The piano cabinet 100 has a flat portion where the keyboard KB is mounted, and the action units AC, hammers HM, dampers DM and strings ST are accommodated in the piano cabinet 100.

The keyboard KB includes white keys 41 and black keys 42, and the white keys 41 and black keys 42 are laid on the well-known pattern in the lateral direction. The white keys 41 and black keys 42 independently pitch up and down, and are moved between rest positions and end positions. The keyboard KB is covered with the fallboard assembly UNT, and a pianist exposes the keyboard KB by rotating the fallboard assembly UNT with respect to the piano cabinet 100.

The action units AC are provided over the rear portions of the white and black keys 41/42, and the rear portions of white and black keys 41/42 are linked with the action units AC, respectively. The hammers HM are provided over the action units AC, and are linked with jacks (not shown) of the action units AC, respectively. When the jacks escape from the associated hammers HM, the hammers HM are driven for rotation toward the strings ST. The strings ST are stretched over the hammers HM, respectively, and the hammers HM are brought into collision with the associated strings ST at the end of the rotation.

A pianist is assumed to depress the front portion of one of the white and black keys 41/42. The rear portion of the depressed key 41/42 gives rise to rotation of the associated action unit AC, and the jack (not shown) escapes from the hammer HM. Then, the jack (not shown) kicks the hammer HM, and the hammer HM starts the free rotation toward the string ST at the escape. The hammer HM gets close and closer to the string ST, and is brought into collision with the string ST at the end of the free rotation. The hammer HM gives rise to vibrations through the collision, and the vibrating string ST generates a tone.

The flat portion of piano cabinet 100 is called as a key bed 11. The piano cabinet 100 further includes a key slip 12, a pair of side arms 13, an upper front board 14 and a pair of key blocks 16. The key bed 11, key slip 12, pair of side arms 13, upper front board 14 and key blocks 16 and other component parts such as a par of side boards (not shown) are assembled into the well-known box-shaped piano cabinet 100.

The key slip 12 is upright from a front portion of the key bed 11, and the white and black keys 41/42 pitch up and down in the space at the back of the key slip 12. While the white and black keys 41 and 42 are staying at the rest positions, the front end surface of the white and black keys 41/42 are seen over the key slip 12. However, when the white and black keys 41 and 42 reach the end positions, the front end surfaces of white and black keys 41/42 are hidden at the back of the key slip 12.

Although the upper front board 14 is not shown in FIG. 1, the upper front board 14 laterally extends over the keyboard KB, and is connected at both sides thereof to the side arms 13. A pair of rubber buttons 15 is provided as a shock absorber. The rubber buttons 15 are secured to side portions of the upper front board 14, and prevent the upper front board 14 from the undesirable shock at the collision with the fallboard assembly UNT.

The side arms 13 are connected to the side boards (not shown), and are placed on both side portions of the key bed 11. The keyboard KB is located between the side arms 13, and the key blocks 16 are provided between both sides of the keyboard KB and the side arms 13. The key slip 12 is held in contact at both side surfaces with the key blocks 16.

The piano cabinet 100 further includes a pair of sloping blocks 17, a key stop rail 18 and a pair of guide blocks 19. The sloping blocks 17 are respectively provided between the side arms 13 and the key blocks 16 in such a manner as to be held in contact with the inner surfaces of the side arms 13 and the outer surfaces of the key blocks 16. The rear portions of the sloping blocks 17 are partially cut out so that clearances 17*a* are formed between the remaining portions of sloping blocks 17 and the side arms as will be seen in FIG. 1.

The gap between the sloping blocks 17 is bridged with the key stop rail 18. The key stop rail 18 laterally extends immediately over the intermediate portions of the white and black keys 41/42, and prohibits the white and black keys 41/42 from jump after the release of the white and black keys 41/42.

The guide blocks 19 are provided at the back of the sloping blocks 17, respectively, and are spaced from the associated sloping blocks 17. The guide blocks 19 have upper surfaces, which slop backwardly. The guide blocks 19 are provided for the fallboard assembly UNT as will be hereinafter described in detail.

The fallboard assembly UNT is connected to the piano cabinet 100 by means of the pair of rotary connectors CON, and includes a hinge 30, a front fallboard 31, a rear fallboard 32 and a pair of sliders 33. The front fallboard 31 is provided in front of the rear fallboard 32, and the hinge 30 is connected between the front fallboard 31 and the rear fallboard 32. The front fallboard 31 is connected at both side portions thereof to the side arms 13 by means of the pair of rotary connectors CON. The pair of rotary connectors CON permits the player to change the fallboard assembly UNT between the closed position and the open position, and the hinge 30 makes the front fallboard 31 folded over the rear fallboard 32 at the open position. The pair of rotary connectors CON takes up the errors in the machining work during an assembling work as will be hereinafter described in conjunction with the assembling work.

The front fallboard 31 and rear fallboard 32 are as wide as the gap between the side arms 13 so that the fallboard assembly UNIT is inserted into the gap between the side arms 13. The front portion of the front fallboard 31 is gently curved at substantially right angle so as to have a cross section like an L-letter. The front portion of front fallboard 31 is held in contact with the key slip 12 at the closed position. The rear fallboard 32 is gently curved at acute angle so that an upper surface of the fallboard assembly UNT extends substantially in parallel to the upper surfaces of the side arms 13.

The sliders 33 are held in contact with the reverse surface of the rear fallboard 32, and are secured to the rear fallboard 32. The sliders 33 are laterally spaced from one another by the distance equal to the distance between the guide blocks 19, and downwardly project onto the upper surfaces of the guide blocks 19, respectively. While a player is changing the fallboard assembly UNT between the closed position and the open position, the sliders 33 slide on the upper surfaces of guide blocks 19.

Since the left rotary connector CON is similar in structure to the right rotary connector, description is made on the left rotary connector CON, and the right rotary connector CON is not described for the sake of simplicity.

Figure 3:
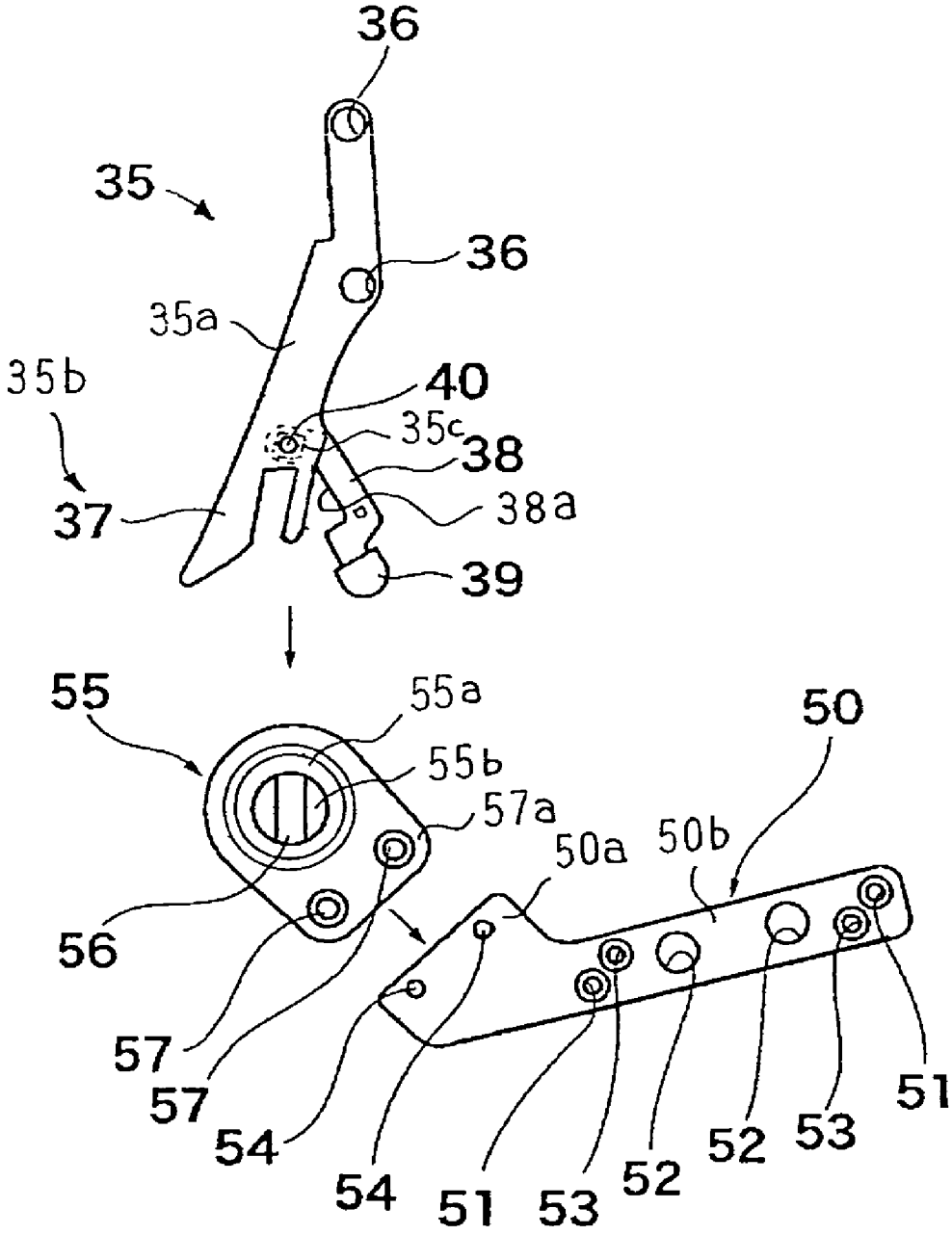
FIG. 3 is a fragmentary side view showing the component parts of a rotary connector.

The rotary connector CON is illustrated in FIG. 3 in detail. The rotary connector CON includes metal plates 35 and 50, a rotary damper 55 and bolts (not shown in FIG. 3). The metal plate 35 is connected to the front fallboard 31, and the other metal plate 50 is connected to the left side arm 13. The rotary damper 55 is provided between the metal plates 35 and 50, and gives counter-moment to the front fallboard 31 immediately before the landing on the key slip 12.

The rotary damper 55 has a cylinder 55*a*, a shaft 55*b*, a bracket 57*a* and a damping mechanism (not shown). The bracket 57*a* is secured to one end portion of the cylinder 55*a*, and a pair of holes 57 is formed in the bracket 57*a*. The shaft 55*b* and damping mechanism (not shown) are provided inside of the cylinder 55*a*. The shaft 55*b* is bi-directionarily rotated in the cylinder 55*a*, and the damping mechanism (not shown) gives resistance against the rotation in one of the directions. The damping mechanism (not shown) does not exert any substantial resistance against the rotation in the other direction. The damping mechanism (not shown) may be same as that disclosed in Japan Patent Application laid-open No. Sho 63-41898, i.e., a coil spring. Otherwise, a partition wall, a check valve provided on the partition wall and fluid sealed in the cylinder may constitute the damping mechanism (not shown). The shaft 55*b* has a thumb-piece 56, and the thumb-piece 56 has side surfaces parallel to one another.

The metal plate 35 is broken down into an arm portion 35*a*, a pinch 35*b* and a lock mechanism 35*c*. The arm portion 35 is bent at obtuse angle. The arm portion 35*a* is formed with a pair of bolt holes 36, and is bolted to the front fallboard 31. The pinch 35*b* is implemented by a stationary finger portion 37, a movable finger portion 38, a binder 39 and a pivot 40. The stationary finger portion 37 and arm 35*a* are formed in a unitary structure, and the movable finger portion 38 is connected at one end portion to the stationary finger portion 37 by means of the pivot 40. For this reason, the movable finger portion 38 is rotatable about the pivot 40. The movable finger portion 38 is formed with a dent 38*a*, and defines a space together with the stationary finger portion 37 when the movable finger portion 38 is brought into contact with the stationary finger portion 37. The thumb piece 56 remains stable in the space. The lock mechanism 35*c* is provided in association with the pivot 40, and prohibits the movable finger portion 38 from being spaced from the stationary infer portion 37.

While the movable finger portion 38 is being spaced from the stationary finger portion 37, gap takes place between the stationary finger portion 37 and the movable finger portion 38, and the gap is wide enough to permit the thumb-piece 56 to enter therein. When the movable finger portion 38 is driven for rotation in the clockwise direction, the gap gets closer and closer. In case where the thumb-piece 56 is placed in the gap, the thumb-piece 56 is pinched between the stationary finger portion 37 and the movable finger portion 38, and the lock mechanism 35*c* keeps the thumb-piece 56 pinched between the movable finger portion 38 and the stationary finger portion 37.

The metal plate 50 has a shape like a stick of the field hockey so that a long portion and a short portion of the metal plate 50 are hereinafter referred to as a blade portion 55*a* and a handle portion 50*b*. The blade portion 50*a* is formed with a pair of holes 54, and the distance between the holes 54 is approximately equal to the distance between the holes 57 in the bracket 57*a* of the rotary connector 55. In other words, an assembling worker can align the holes 54 with the holes 57, respectively, and bolts the rotary damper 55 to the metal plate 50.

Two pairs of main holes 51 and 52 and a pair of auxiliary holes 53 are formed in the handle portion 53. Although the main holes 51 are spaced from the other main holes 52, the auxiliary holes 52 are closed to the main holes 51, respectively. The handle portion 50*b* is secured to the side arm 13, and the main holes 51 and 52 are usually used for the assemblage between the piano cabinet 100 and the fallboard assembly UNT. If the error in machining work is serious, the assembling working separates the metal plate 50 from the side warm 13, and secured the metal plate 50 to the side arm 13, again, by using the auxiliary holes 53 as will be described in the conjunction with the assembling work.

Figure 4:
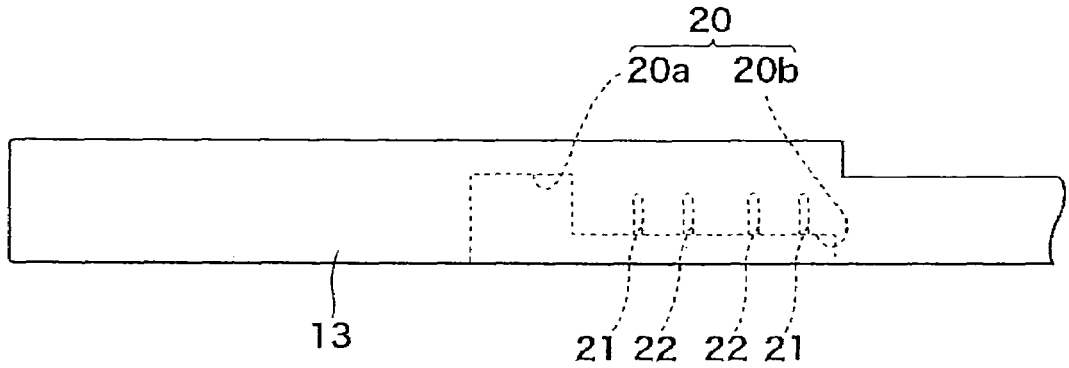
FIG. 4 is a plane view showing a front portion of a side arm forming a part of the cabinet of the keyboard musical instrument.

Turning to FIG. 4 of the drawings, the side arm 13 is formed with a recess 20 and two pairs of bolt holes 21 and 22. The recess 20 is open onto the inner side surface of the side arm 13, and has a deep pocket portion 20*a* and a shallow plate portion 20*b*. The deep pocket portion 20*a* is assigned to the rotary damper 55, and the shallow plate portion 20*b* is assigned to the metal plate 50. The deep pocket portion 20*a* and shallow plate portion 20*b* are wider and longer than the rotary damper 55 and the metal plate 50 so that the rotary damper 55 and plate 50, which are assembled with one another, are movable in the fore-and-aft direction and up-and-down direction, i.e., on a virtual plane defined by the fore-and-aft direction and up-and-down direction. In other words, the recess 20 offers a tolerance to the rotary damper 55 and metal plate 50.

Two pairs of prepared holes 21 and 22 are formed in the side arm, and laterally penetrate into the side arm 13 from the bottom of the shallow plate portion 20*b*. The prepared holes 21 and 22 are formed before the assembling work. The prepared holes 21 are spaced from each other by the distance equal to the distance between the holes 51, and the other prepared holes 22 are spaced from each other by the distance equal to the distance between the holes 52. For this reason, the holes 51 and 52 are aligned with the prepared holes 21 and 22, respectively.

Figure 5:
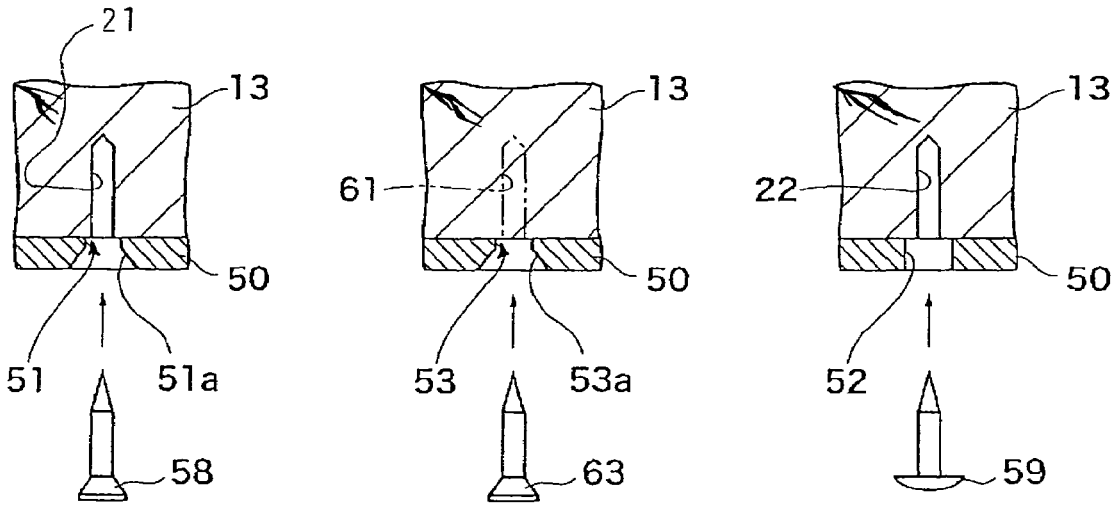
FIGS. 5A to 5C are cross sectional views showing bolts and bolt holes formed in the side arm.

As shown in FIGS. 5A and 5B, the prepared holes 21 are used for flat countersunk head woodscrews 58, and the other prepared holes 22 are used for truss head self-tapping screws 59. For this reason, countersinks 51*a* are formed in the metal plate 50 for the flat countersunk head woodscrews 58. However, the holes 52 are defined by straight walls. The prepared holes 21 are spaced wide enough to drive countersunk head woodscrews 63 (see FIG. 5C into the side arm 13 through the auxiliary holes 53. When the assembling worker thinks the error is serious, he or she forms prepared holes 61 between the prepared holes 21 and the prepared holes 22 in the assembling work, and the metal plate 50 is secured to the side arm 13 by means of the flat countersunk head woodscrews 63 instead of the flat countersunk head wood screws 58. Since the flat countersunk head woodscrews 63 are driven into the side arm 13, the holes 53 are also formed with countersinks 53*a*.

In this instance, the flat countersunk head woodscrews 58 are 3.5 millimeters in diameter. The metal plate 50 is adjusted to a proper position for a default position by means of the flat countersunk head woodscrews 58 on the condition that any serious machining error is not found. The default position is defined as "a position for the rotary connector CON at which most of the fallboard assemblies UNT are properly installed with respect to the piano cabinets 100". In other words, when the rotary connectors CON are located at the default position, the fallboard assemblies UNT are properly assembled with the piano cabinets 100 at the highest possibility. The holes 51 are aligned with the prepared holes 21, and the metal plate 50 is bolted to the side arm at the proper position. Accordingly, the holes 51 are 3.8 millimeters in diameter.

On the other hand, the truss head self-tapping screws 59 are used for temporary tacking between the metal plate 50 and the side arm 13. In this instance, the truss head self-tapping screw 59 are 5 millimeters in diameter. In order to give a large tolerance to the alignment with the prepared holes 22, the holes 52 are 9 millimeters in diameter. Of course, the assembling worker tightens the truss head self-tapping screws 59 into the side arm 13 after the metal plate 50 is accurately secured to the side arm 13 by means of the flat countersunk head woodscrews 58 or 63.

In this instance, the peripheries defining the main holes 51/52 and auxiliary hole 53, flat countersunk head woodscrews 58/63 and truss head self-tapping screw 59 serve as the two-dimensional position adjuster.

When the fallboard assembly UNT is offset from the key slip 12, by way of example, the assembling worker loosens and removes the flat countersunk head woodscrews 58 from the side arm 13, regulates the position between the side arm 13 and the metal plate 50, and secures the metal plate 50 to the side arm 13 at a proper position by means of the flat countersunk head woodscrew 63 instead of the flat countersunk head woodscrews 58. Thus, the flat countersunk head woodscrews 63 are alternatively used for the metal plate 50. For this reason, the flat countersunk head woodscrews 63 are equal in diameter to the flat countersunk head woodscrews 58, and the hole 53 is 3.8 millimeters in diameter. In case where the fallboard assembly UNT is properly installed by means of the rotary connectors CON at the default positions, the holes 53 are useless as will be seen in FIG. 6. Of course, when the assembling worker finds the offset between the fallboard assembly UNT and the key slip 12, the assembling worker secures the metal plates 50 to the side arms 13 by means of the flat countersunk head woodscrews 63 instead of the flat countersunk head woodscrew 58.

Figure 7:
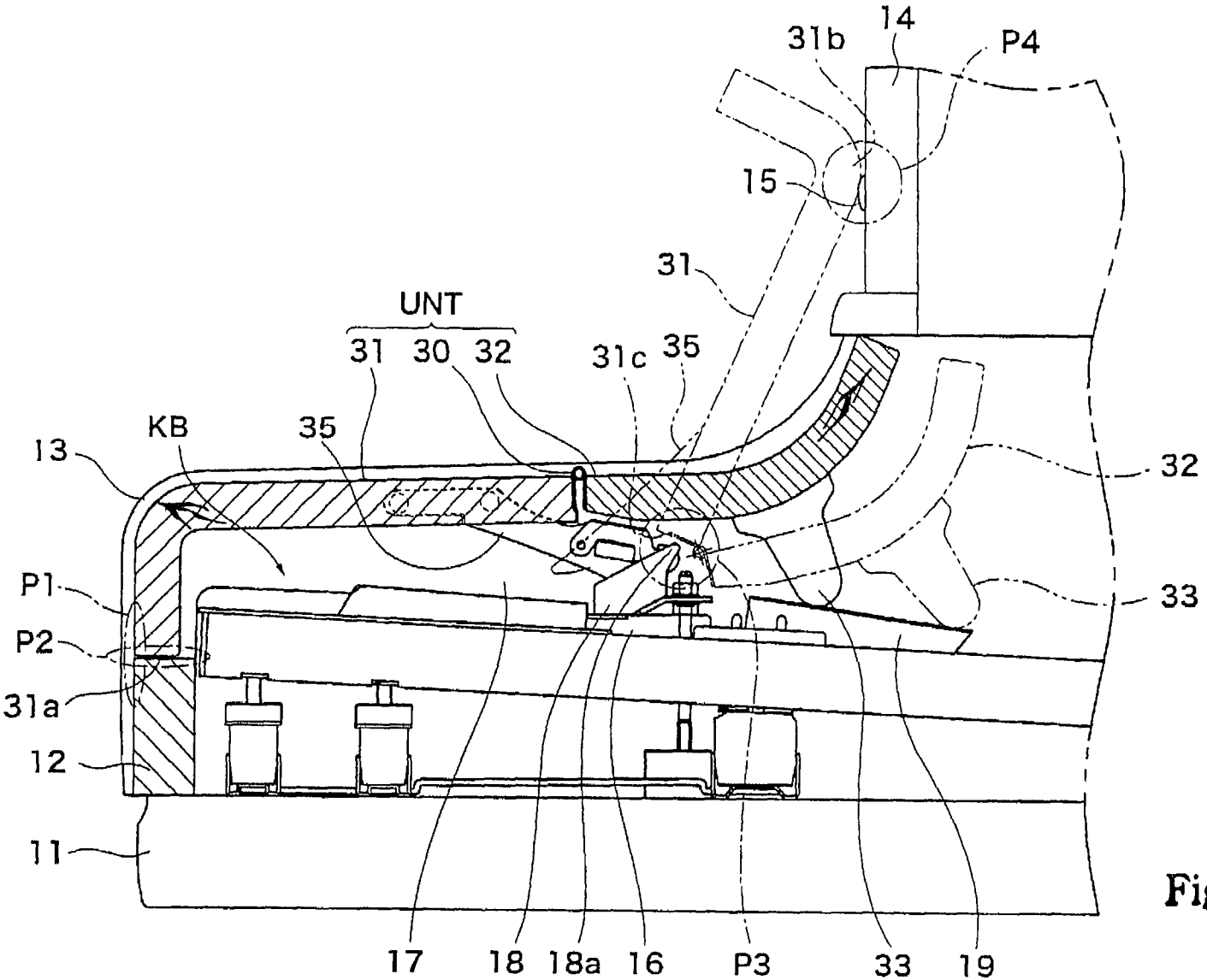
FIG. 7 is a partially cut-out side view taken along line A-A of FIG. 1 and showing the behavior of the fallboard assembly UNT.

Subsequently, description is made on the behavior of the fallboard assembly UNT with reference to FIG. 7. In order to make the behavior clearly understood, the sloping block 17, rotary damper 55 and metal plate 50 are eliminated from the keyboard musical instrument. Real lines are indicative of the fallboard assembly CNT at the closed position, and dots-and-dash lines are indicative of the fallboard assembly CNT at the open position.

A player is assumed to expose the keyboard KB to himself or herself. The player lifts the front fallboard 3 1, and rotates the front fallboard 31 about the hinge 32. The player pushes the front fallboard 31, and folds the front fallboard 31 over the rear fallboard 32. The sliders 33 slide on the guide blocks 19, and cause the rear fallboard 32 to raise the rear portion thereof. Accordingly, the front portion of the rear fallboard 31 and hinge 30 are sunk toward the front ends of the guide blocks 19. On the other hand, the front fallboard 31 is getting closer and closer to the upper front board 14. Finally, the front fallboard 31 is brought into contact with the rubber buttons 15, and rests on the upper front board 14.

While the player is covering the keyboard KB with the fallboard assembly UNT, the front fallboard 31, rear fallboard 32 and sliders 33 are moved vice versa. When the fallboard assembly UNT reaches the closed position, the front fallboard 31 rests on the key slip 12, and the hinge 30 makes the upper surface of the front fallboard 31 flatly continued to the upper surface of the front portion of the rear fallboard 32.

Subsequently, description is made on the assembling work. Firstly, preparation work is carried out. The followings are contained in the preparation work. The upper front board 14 remains disassembled from the piano cabinet 100 so as to make the assembling worker easily accessed into the inner space.

The assembling worker forms the recesses 20 in the side arms 13, and drills the two pairs of prepared holes 21 and 22 in each of the side arms 13. The deep pocket portions 20*a* and shallow plate portions 20*b* are oversized so as to permit the assembling worker to move the rotary dampers 55 already combined with the metal plates 50 on the virtual planes defined by the lateral direction and up-and-down direction after insertion into the recesses 20. The prepared holes 21 and 22 are located at the proper positions at which the rotary connectors CON respectively take the default positions. The two pairs of prepared holes 21 and 22 laterally penetrate from the bottom of the shallow plate portion 20*b* into each of the side arms 13 as described with reference to FIG. 4.

Figure 6:
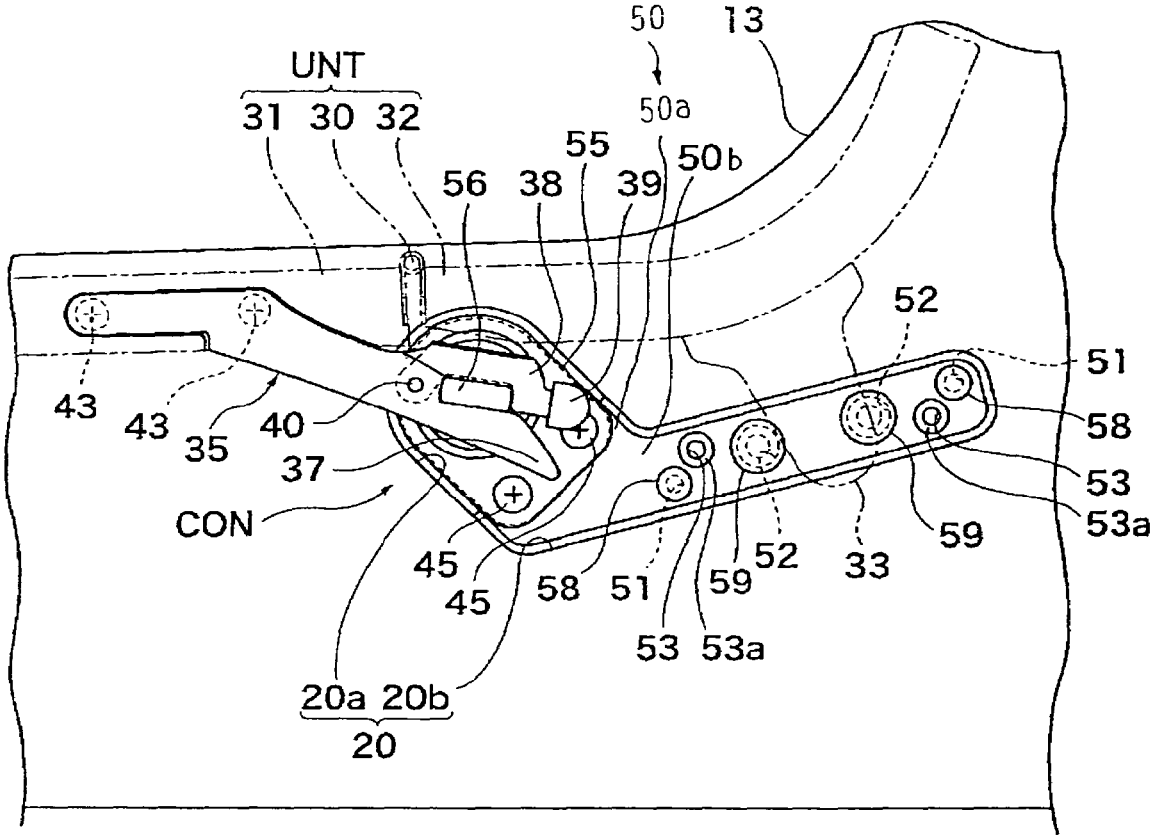
FIG. 6 is a side view showing a rotary connector provided between the cabinet and the fallboard assembly.

The rotary dampers 55 are combined with the metal plates 50 by means of countersunk head screws 45 (see FIG. 6). However, the other metal plates 35 are not connected to the thumb piece 56 of the shaft 55*b*. The metal plates 35 are secured to both side surfaces of the front fallboard 31 by means of woodscrews 43, respectively. The woodscrews 43 are seen in FIG. 6.

The drill work, combining work on the rotary dampers 55 and the metal plates 50 and connecting work on the metal plates 35 may be carried out in a different order from that hereinbefore described.

Subsequently, the holes 51 and 52 are respectively aligned with the prepared holes 21 and 22, and the flat countersunk head woodscrews 58 and truss head self-tapping screws 59 are driven into the prepared holes 21 and 22 through the holes 51 and 52 as shown in FIGS. 5A and 5B. The metal plates 50 are temporarily tacked to the side arms 13 at the proper position for the default position.

Figure 8:
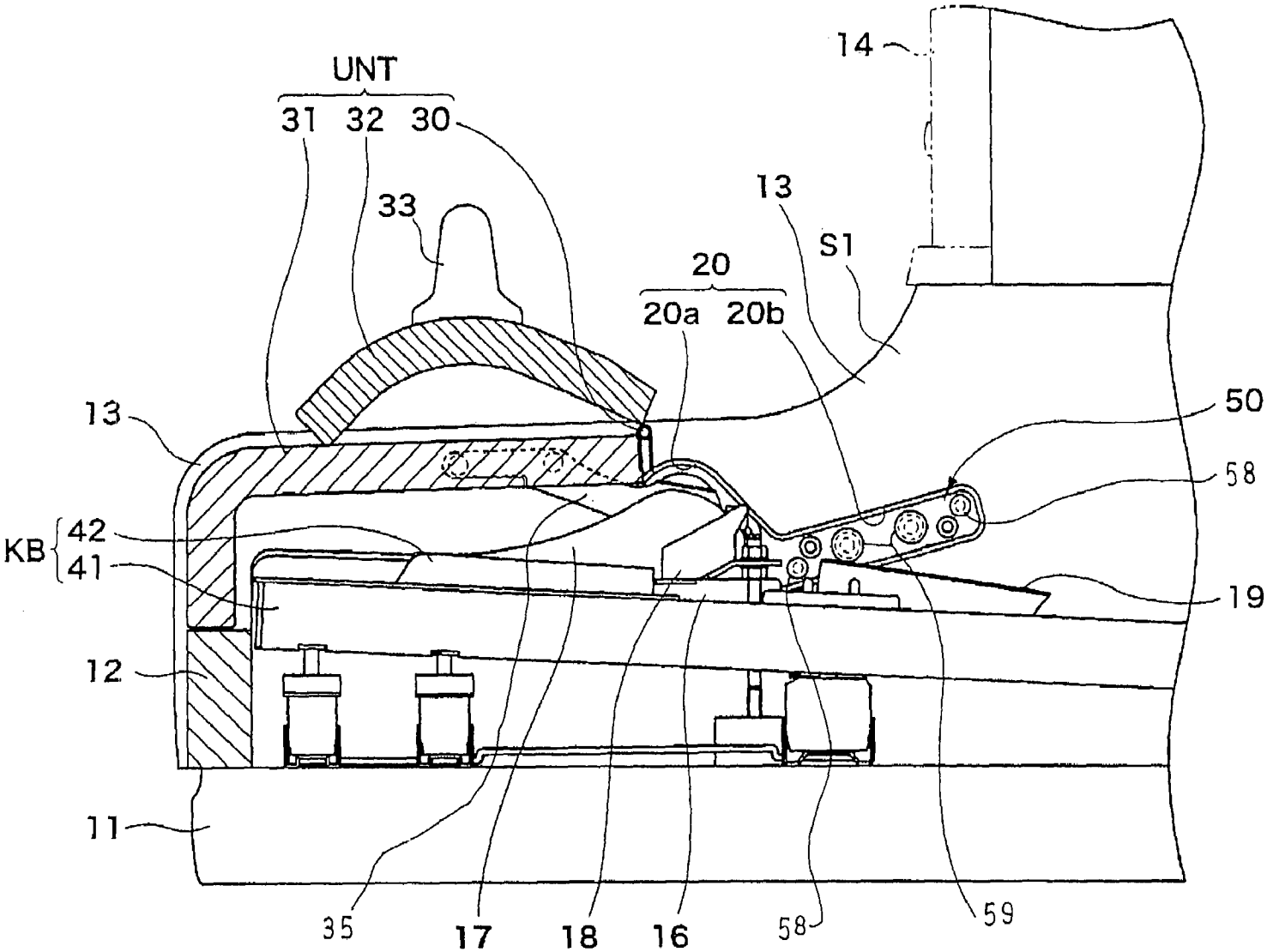
FIG. 8 is a partially cut-out side view taken along line A-A of FIG. 1 and showing the fallboard assembly folded during an assembling work.

Subsequently, the keyboard KB is covered with the fallboard assembly UNT. The rear fallboard 32 is folded on the front fallboard 31 as shown in FIG. 8. Since the upper front board 14 remains disassembled or is removed from the piano cabinet 100, dots-and-dash lines are indicative of the space in which the upper front board 14 will occupy in FIG. 8, and the disassembled upper front board 14 and folded rear fallboard 32 offer wide space S1 to the assembling worker.

Subsequently, the metal plates 35 are connected to the shaft 55*b* by means of the pinch 35*b*. The metal plate 35 has the stationary finger portion 37 held in contact with the thumb piece 56. The assembling worker moves the movable finger portion 38 toward the thumb piece 56, and pinches the thumb piece 38 between the stationary finger portion 37 and the movable finger portion 38. The binder 39 keeps the thumb piece 56 pinched between the stationary finger portion 37 and the movable finger portion 38. As a result, the front fallboard 31 becomes rotatable about the center axis of the shaft 55*b*. The rear fallboard 32 is rotatable about the hinge 30.

Subsequently, the assembling worker checks boundaries P1, P2, P3 and P4 (see FIG. 7) to see whether or not the fallboard assembly UNT is three-dimensionally properly assembled with the piano case 100. When the front surface of the front fallboard 31 is coplanar with the front surface of the key slip 12 along the boundary P1, the assembling worker determines that the boundary P1 is proper, and confirms that the rotary connectors CON are properly positioned on the virtual planes defined by the fore-and-aft direction and the up-and-down direction. If a step takes place at the boundary P1, the rotary connectors CON are to be regulated to proper positions on the virtual planes defined by the fore-and-aft direction and the up-and-down direction. When the gap between the front fallboard 31 and the key slip 12 is constant in the lateral direction, the assembling worker determines the boundary P2 is proper, and confirms that the fallboard assembly UNT extends between the virtual planes defined by the fore-and-aft direction and the up-and-down direction at right angle. If the gap is varied, the fallboard assembly UNT obliquely extends between the virtual planes, and one of the rotary connectors CON is to be changed from the default position to a proper position. Although the metal plates 50 are to be inclined from the bottom surfaces of the shallow plate portions 20*b* in the strict sense, it is possible for the assembling worker to eliminate the inclination from between the fallboard assembly UNT and the piano cabinet 100 by making one of the rotary connectors CON deviate from the default position in so far as the inclination is a little.

Subsequently, the assembling worker changes the fallboard assembly UNT to the open position, and checks the boundaries P3 and P4. In detail, the assembling worker lifts the front portion of the front fallboard 31, and backwardly pushes the front fallboard 31. Then, the sliders 33 are backwardly moved along the upper surfaces of the guide blocks 19, and the hinge 30 gets close to the key stop rail 18. Finally, the front fallboard 31 is folded over the rear fallboard 32.

The assembling worker measures the gap between the upper rear end 18*a* of the key stop rail 18 and the rear end surface 31*c* of the front fallboard 31. When the gap is constant along the key stop rail 18, the boundary P3 is proper, and the fallboard assembly UNT is adjusted to a proper height properly. Although it is desirable to make the key stop rail 18 as close as possible, the key stop rail 18 is not to interrupt the fallboard assembly UNT during the movement between the closed position and the open position. If the fallboard assembly CON is interrupted with the key stop rail 18 during the travel from the closed position to the open position, at least one of the rotary connectors CON is to be moved on the virtual plane defined by the up-and-down direction and the fore-and-aft direction.

Finally, the assembling worker assembles or reassembles the upper front board 14 into the piano cabinet 100, and checks the boundary P4 to see whether or not the front fallboard 31 properly rests on the rubber buttons 15. When the front fallboard 31 is held in contact with both of the rubber buttons 15, the assembling worker determines that the boundary P4 is proper. On the other hand, if the front fallboard 31 is held in contact with one of the rubber buttons 15 i.e., a gap is found between the other rubber button 15 and the front fallboard 31, the assembling worker notices the fallboard assembly UNT obliquely extending between the virtual planes defined by the up-and-down direction and the fore-and-aft direction, and moves one of the rotary connectors CON on the virtual plane. Although the metal plates 50 are to be inclined from the bottom surfaces of the shallow plate portions 20*b* in the strict sense, it is possible for the assembling worker to eliminate the inclination from between the fallboard assembly UNT and the piano cabinet 100 by making one of the rotary connectors CON deviate from the default position in so far as the inclination is a little.

Thus, the assembling worker investigates the relative position of the fallboard assembly UNT to the piano cabinet 100 at the boundaries P1, P2, P3 and P4. When the assembling worker confirms that all of the boundaries P1, P2, P3 and P4 are proper, the rotary connectors CON are fixed to the default positions on the virtual planes defined by the up-and-down direction and fore-and-aft direction. The holes 53 (see FIG. 3) are useless.

If, on the other hand, at least one of the boundaries P1 to P4 is improper, the assembling worker measures the variance, and estimates the proper position or positions on the virtual plane or planes.

The assembling worker removes the upper front board 14 from the piano cabinet 100, again. The assembling worker loosens the flat countersunk head woodscrews 58, and draws the flat countersunk head woodscrews 59 out from the side arms 13. The assembling worker loosens the truss head self-tapping screws 59 so as to make the metal plate or plates 50 movable on the virtual plane or planes. The metal plates 50, which have been combined with the rotary dampers 55 already connected to the other metal plates 35, are still temporarily tacked to the side arms 13 by means of the truss head self-tapping screws 59. Since the holes 52 are wider than the cross sections of the truss head self-tapping screws 59, the assembling worker can move the metal plates 50 on the shallow plate portions 20*b* without pulling out the truss head self-tapping screws 59 from the side arms 13. Thus, the assembling worker moves the metal plates 50 from the proper positions for the default positions to new proper positions estimated through the investigation.

The assembling worker drills the prepared holes 61 (see FIG. 5C) in the side arms 13 through the auxiliary holes 53, and drives the flat countersunk head woodscrews 63 into the side arms 13. The truss head self-tapping screws 59 are driven into the side arms 13, again. Thus, the rotary connector or connectors CON are fixed to the side arms 13 at optimum positions. As a result, the fallboard assembly UNT is properly installed with respect to the piano cabinet 100, and the fallboard assembly UNT is changed between the closed position and the open position on the condition that the fallboard assembly UNT forms the proper boundaries P1 to P4 together with the key slip 12, key stop rail 18 and rubber buttons 15.

The above-described assembling work is usually carried out in a manufacturing factory before delivery to users. However, an adjustment work may be required for the fallboard assembly UNT after a repairing work at user's home. A repairing worker visits the user's home, and seeks the optimum position for the fallboard assembly UNT. Since the metal plates 35 are separable from the rotary dampers 55, the repairing worker folds the rear fallboard 32 on the front fallboard 31, and the folded rear fallboard 32 offers the wide space S1 to the repairing worker.

As will be understood from the foregoing description, the metal plate 50 is formed with the main holes 51 and auxiliary holes 53, and the holes 52 are wider than the truss head self-tapping screws 59. In other words, the rotary connectors CON are movable on the virtual planes defined by the up-and-down direction and fore-and-aft direction. Even if the fallboard assembly UNT does not properly assembled with the piano cabinet 100 at the default position of the rotary connectors CON, the worker can move the rotary connectors CON from the default positions to the optimum positions, and fixes the rotary connectors CON to the optimum positions without any replacement of the metal plates 50 with new ones. By virtue of the rotary connectors CON of the present invention, the fallboard assembly UNT is properly assembled with the keyboard musical instrument without increase of production cost.

The rotary connectors CON are independently moved on the virtual planes, the assembling worker can eliminate the inclination and twist of the fallboard assembly UNT from between the cabinet 100 and the fallboard assembly UNT.

The split structure of the fallboard assembly UNT is desirable from the view point of easiness of the assembling work and repairing work, because the folded rear fallboard 32 offers the wide space to the workers.

The two sorts of screws make the assembling work and repairing work speedy. The truss head self-tapping screws 59 permit the worker temporarily to tack the rotary connectors CON to the side arms 13 so that the workers can seek the optimum position in the temporary tacked state. On the other hand, even if the truss head self-tapping screws 59 are once loosened, the flat countersunk head woodscrews 63 fix the rotary connectors CON to the optimum positions.

Second Embodiment

Figure 10:
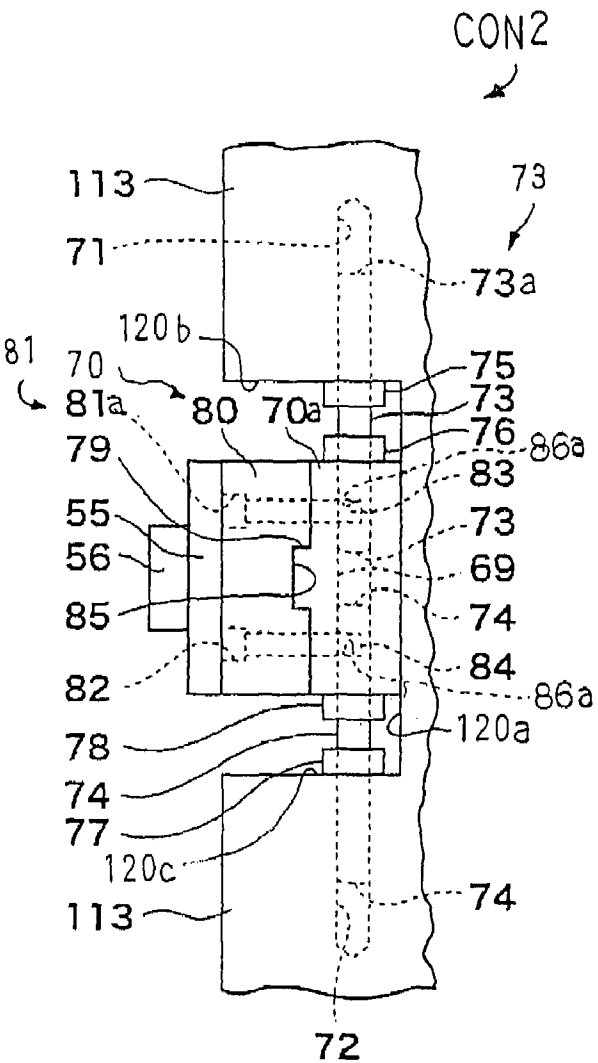
FIG. 10 is a rear view showing the rotary connector.
Figure 9:
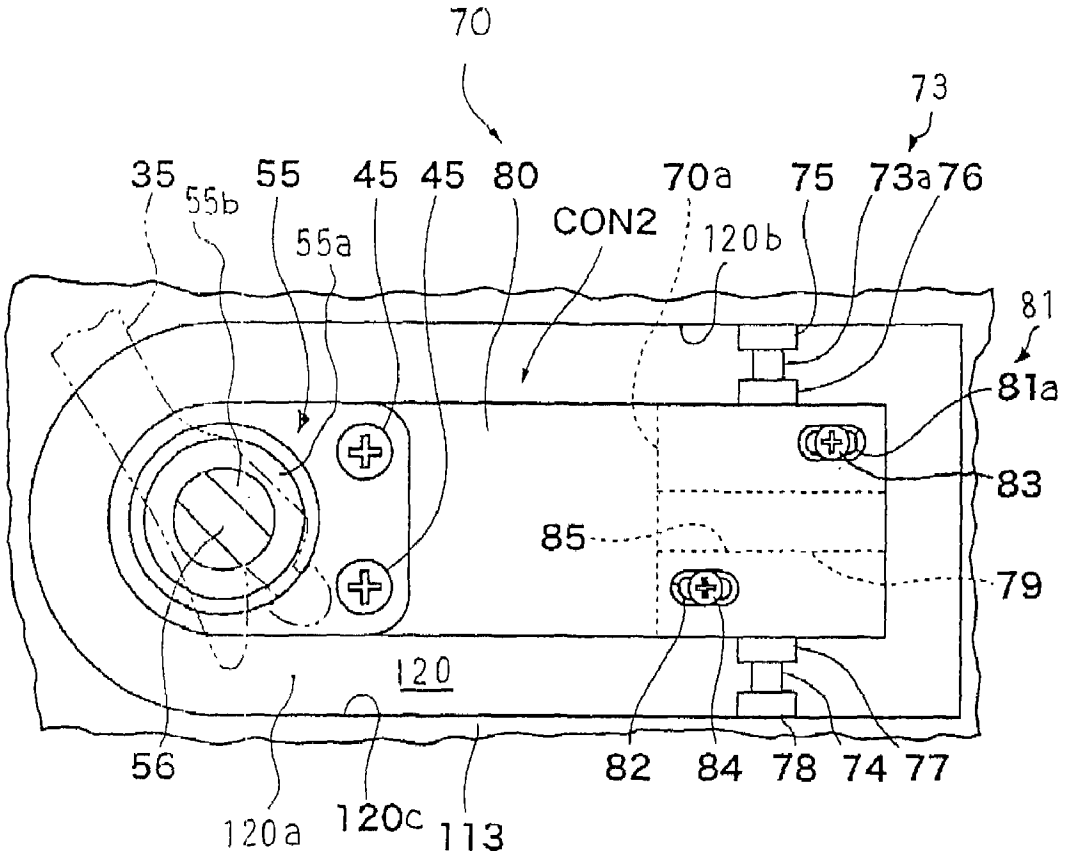
FIG. 9 is a side view showing a rotary connector incorporated in another keyboard musical instrument of the present invention.

Turning to FIGS. 9 and 10 of the drawings, a rotary connector CON2 is incorporated in another piano embodying the present invention. The piano is similar to the piano shown in FIGS. 1 and 2 except for recesses 120 formed in side arms 113. For this reason, component parts of the piano are hereinafter labeled with references designating corresponding parts of the piano implementing the first embodiment without detailed description. Although a pair of rotary connectors CON2 is provided between the piano case 100 and the fallboard assembly UNT, the rotary connectors CON2 are similar in structure to each other so that only the left rotary connector CON2 is described with reference to FIGS. 9 and 10 for avoiding repetition.

The recess 120 is open onto the inner surface of the side arm 130, and a bottom surface, an upper inner surface and a lower inner surface are labeled with references 120*a*, 120*b* and 120*c*, respectively. The recess 120 is substantially constant in depth, i.e., the distance between the inner surface of the side arm 113 and the bottom surface 120*a*, and the bottom surface 120*a* extends in parallel to a virtual plane defined by the fore-and-aft direction and up-and-down direction.

The rotary connector CON2 includes a front metal plate, a rotary damper and a supporting block 70. The front metal and rotary damper are same as those of the first embodiment, and, for this reason, are labeled with reference numerals 35 and 55. The supporting block 70 is two-dimensionally movable on the virtual plane so that an assembling worker adjusts the rotary connector CON2 to the optimum position by means of the supporting block 70.

The supporting block 70 includes an inner plate 70*a*, an outer plate 80, a vertical position adjuster 73 and a horizontal position adjuster 81. The inner plate 70*a* is combined with the outer plate 80, and the outer plate 80 is slidable on the inner plate 70*a* in the fore-and-aft direction. The vertical position adjuster 73 is provided between the inner plate 70*a* and the upper and lower inner surfaces 120*b*/120*c*, and permits the assembling worker to change the position of the inner and outer plates 70*a* / 80 in the up-and-down direction. The horizontal position adjuster 81 is provided between the inner plate 70*a* and the outer plate 80, and permits the assembling worker to change the position of the outer plate 80 in the fore-and-aft direction.

The inner plate 70*a* has a rectangular parallelepiped configuration, and is supported by the side arm 113 through vertical position adjuster 73. The inner plate 70*a* is formed with a guide rail 79, and the guide rail 79 extends in the fore-and-aft direction. The outer plate 80 is longer than the inner plate 70*a*, and the rotary damper 55 is secured to the front end portion of the outer plate 80 by means of bolts 45. A groove 85 is formed in the rear portion of the outer plate 80, and extends in the fore-and-aft direction. The guide rail 79 is received in the groove 85, and is same in cross section as the guide groove 85. When the assembling worker exerts force on the outer plate 80 in the fore-and-aft direction, the outer plate 80 slides on the guide rail 79 in the fore-and-aft direction, and the outer plate 80 changes the relative position to the inner plate 70*a*. The inner surfaces defining the groove 85 and guide rail 79 form other component parts of the horizontal position adjuster 81.

The recess 120 is longer than the outer plate 80 so as to allow the outer plate 80 to slide on the rail 79. The upper surfaces of the inner and outer plates 70*a*/80 are spaced from the upper inner surface 120*b*, and the lower surfaces of the inner and outer plates 70*a*/80 are spaced from the lower inner surface 120*c*. Thus, the recess is wide enough to permit the assembling worker to move the inner and outer plates 70*a*/80, i.e., supporting block 70 in the up-and-down direction as well as in the fore-and-aft direction.

The vertical position adjuster 73 includes female a female screw 69, female screws 71, 72, male screws 73*a*/74 and lock nuts 75/76/77/78. The female screw 69 is formed in the inner plate 70*a*, and passes through the inner plate 70*a* in the up-and-down direction. The female screw 69 has upper and lower openings on the upper and lower surfaces of the inner plate 70. The female screws 71 and 72 are formed in the side arm 113, and extend in the up-and-down direction. The female screws 71 and 72 respectively have a lower opening on the upper inner surface 120*b* and an upper opening on the lower inner surface 120*c*, and the upper and lower openings of the female screw 69 are opposed to the lower opening of the female screw 71 and the upper opening of the female screw 72, respectively. The male screw 73*a* is meshed with the female screws 71 and 73*a*, and the other male screw 74 is meshed with the female screws 72 and 73*a*. The lock nuts 75 and 76 are meshed with the male screw 73 between the lower inner surface 120*b* and the inner plate 70*a*, and the lock nuts 77 and 78 are meshed with the male screw 74 between the inner plate 70*a* and the upper inner surface 120*c*.

While the lock nuts 75, 76, 77 and 78 are being tightly held in contact with the lower inner surface 120*b*, upper and lower surfaces of the inner plate 70*a* and upper inner surface 120*c*, the male screws 73*a* and 74 are not driven for rotation, and the inner plate 70*a* is maintained at the present position. The assembling worker is assumed to move the supporting block 70, downwardly.

The lock nuts 76 and 77 are driven for rotation so as to be spaced from the inner plate 70*a* and upper inner surface 120*c*, and the male screws 73*a* and 74 are driven into the inner plate 70*a* and side arm 113, respectively. As a result, the supporting block 70 is pulled down until the lock nuts 76 and 77 are brought into contact with the inner plate 70*a* and the upper inner surface 120*c*. Thereafter, the lock nuts 75 and 78 are rotated so as to be brought into contact with the lower inner surface 120*b* and lower surface of the inner plate 70*a*.

On the contrary, the assembling worker upwardly moves the supporting block 70 as follows. The lock nuts 75 and 78 are driven for rotation in the direction to form gap between the lock nuts 75 and 78 and the lower inner surface 120*b* and inner plate 70*a*, and the male screws 73*a* and 74 are driven into the side arm 113 and the inner plate 70*a*, respectively. As a result, the supporting block 70 is pulled up until the lock nuts 75 and 78 are brought into contact with the lower inner surface 120*b* and inner plate 70*a*. Thereafter, the lock nuts 76 and 77 are rotated so as to be brought into contact with the upper surface of inner plate 70*a* and upper inner surface 120*c*.

Thus, the supporting block 70 is adjusted to a proper position by means of the vertical position adjuster 73, and the rotary damper 55 and metal plate 35 also changes their position together with the supporting block 70.

The horizontal position adjuster 81 includes peripheries of the outer plate 80 defining holes 81*a* and 82, male screws 83 and 84 and female screws 86*a* formed in the inner plate 70*a*. The holes 81 a and 82 are elongated in the fore-and-aft direction, and the male screws 83 and 84 are meshed with the female screws 86*a*. As described hereinbefore, the outer plate 80 is slidable on the rail 79 in the fore-and-aft direction so that the assembling worker changes the relative position between the inner plate 70*a* and the outer plate 80. When the assembling worker adjusts the supporting block 70 to a proper position in the fore-and-aft direction, the assembling worker loosens the male screws 83 and 84, and slides the outer plate 80 on the rail 79. The elongated holes 81*a* and 82 permits the outer plate 80 slide in the fore-and-aft direction. When the outer plate 80 reaches the proper position, the assembling worker drives the male screws 83 and 84 into the female screws 86*a* so as to press the outer plate 80 to the inner plate 70*a*. Thus, the supporting block 70 is adjusted to the proper position in the fore-and-aft direction by virtue of the horizontal position adjuster 81.

In this instance, the vertical position adjuster 73 and horizontal position adjuster 81 serve as the two-dimensional position adjuster.

The assembling work is similar to that for the first embodiment except for the adjustment of the rotary connector CON2 to the optimum position. The rotary connectors CON2 are positioned at the default positions, and the assembling worker checks the boundaries PI to P4 to see whether or not the fallboard assembly UNT is properly assembled with the piano case 100. If not, the rotary connectors CON2 are moved to the optimum position. In the step of adjusting the rotary connectors CON2 to the optimum position, the assembling worker two-dimensionally moves the rotary connectors CON2, and fixes the rotary connectors CON2 at the optimum position by means of the vertical and horizontal adjusters 73 and 81.

The rotary connectors CON2 are movable on the virtual planes defined by the fore-and-aft direction and up-and-down direction with the assistance of the vertical and horizontal position adjusters 73 and 81 so that the worker properly assembles the fallboard assembly UNT with the piano cabinet 100 as similar to the first embodiment. The supporting block 70, vertical position adjuster 73 and horizontal position adjuster 81 are repeatedly used for the piano, because any woodscrew is not incorporated in the supporting block 70.

Third Embodiment

Figure 11:
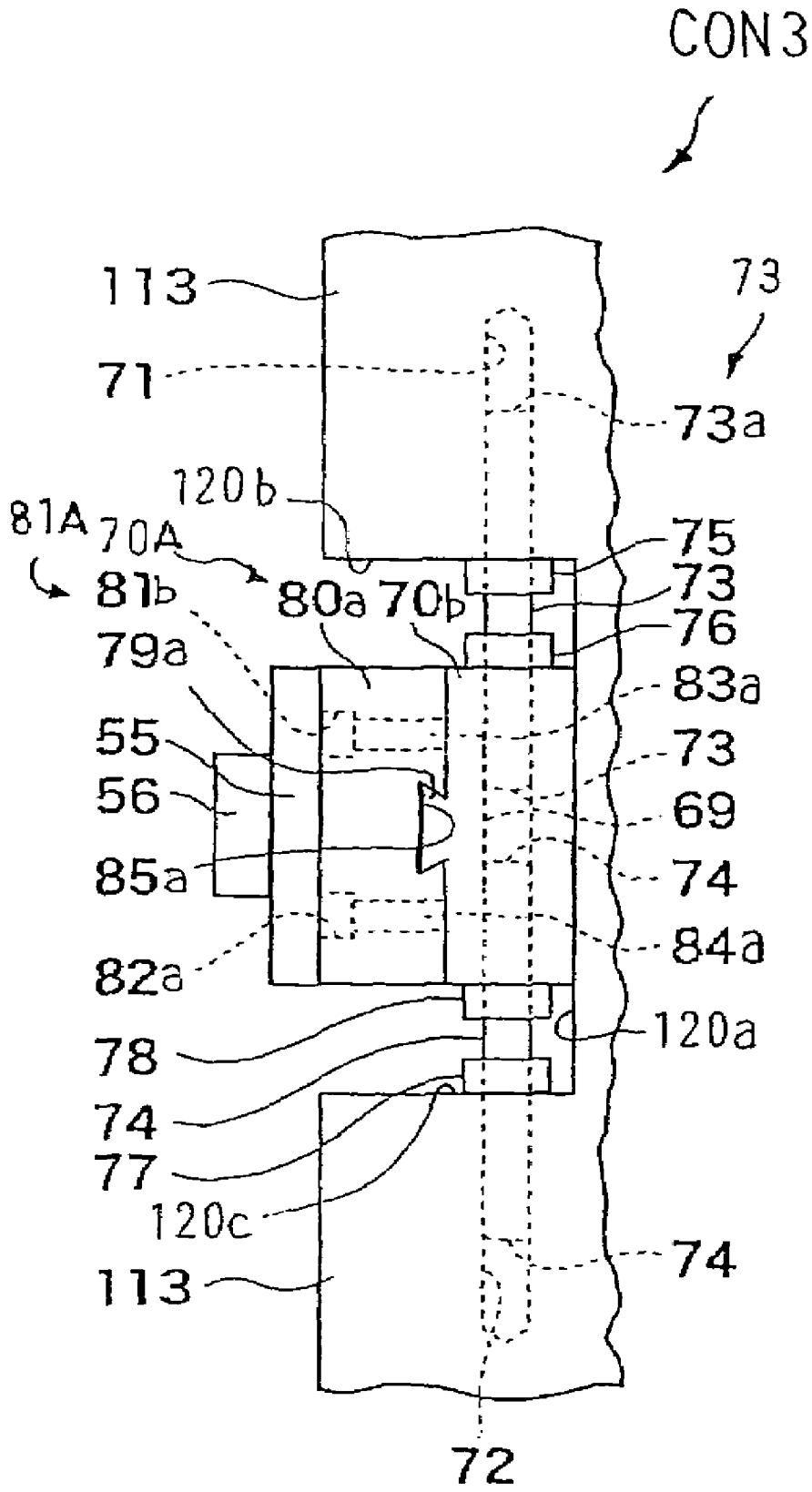
FIG. 11 is a rear view showing yet another rotary connector.

Turning to FIG. 11 of the drawings, yet another rotary connector CON3 embodying the present invention includes a front metal plate (not shown), a rotary damper 55 and a supporting block 70A. A pair of rotary connectors CON3 is provided between a fallboard assembly (not shown) and a piano cabinet of an upright piano. Although a side arm 113 is illustrated in FIG. 11, the other component parts of the upright piano are not described, because they are same as those of the upright piano of the first embodiment.

The rotary connector CON3 is similar in structure to the rotary connector CON2 except for a horizontal position adjuster 81A. For this reason, the other component parts of the rotary connector CON3 are labeled with references designating the corresponding component parts of the rotary connector CON2 without detailed description.

Although the elongated holes 8 la and 82 are required for the movement of the outer plate 80 in the fore-and-aft direction in the second embodiment, the horizontal position adjuster 81A requires neither elongated holes nor female screw. Since a rail 79*a* and a guide groove 85*a* have an inverted trapezoidal cross section, although the outer plate 80*a* is slidable on the rail 79*a* in the fore-and-aft direction, the outer plate 80*a* and inner plate 70*b* are not separable from each other in the lateral direction. For this reason, the assembling worker loosens bolts 81*b* and 82*a*, moves the outer plate 80*a* to the proper position in the fore-and-aft direction, and tightens the outer plate 80*a* at the proper position by pressing the bolts 81*b* and 82*a* to the inner plate 70*b*.

In this instance, the vertical position adjuster 73 and horizontal position adjuster 81A serve as the two-dimensional position adjuster. The rotary connector CON3 achieves all the advantages of the rotary connector CON2.

As will be appreciated from the foregoing description, the two-dimensional position adjusters are provided in association with the rotary connector CON, CON2 and CON3 so that the workers can properly easily assemble the fallboard assembly UNT with the piano cabinet 100.

Fourth Embodiment

Figure 12:
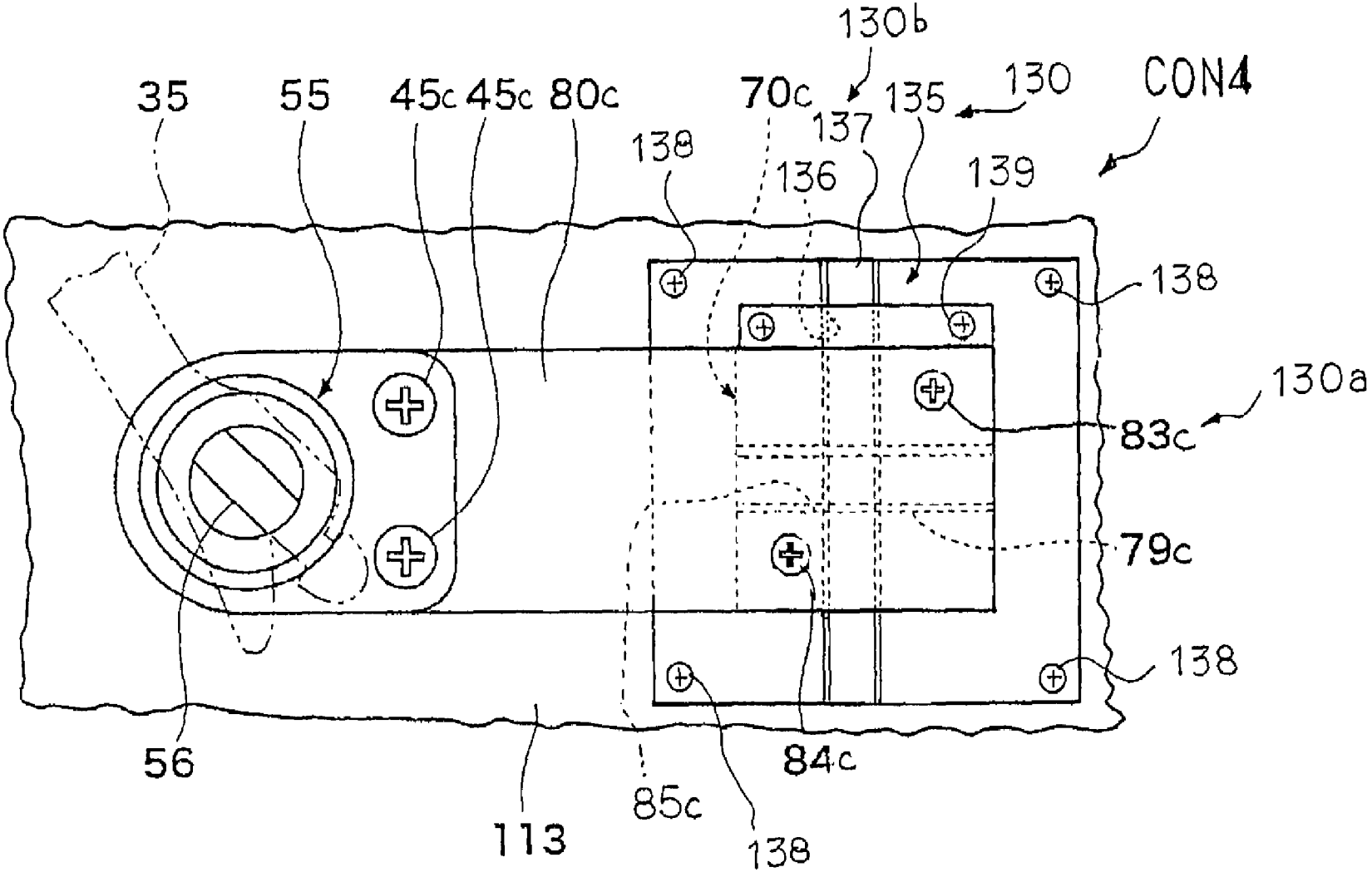
FIG. 12 is a side view showing still another rotary connector.

Turning to FIG. 12 of the drawings, still another rotary connector CON4 is connected between the side arm 113 and the fallboard assembly (not shown), and includes a supporting block 130, the front metal plate 35 and rotary damper 55. The front metal plate 35 and rotary damper 55 are same as those of the first and second embodiments. For this reason, description is focused on the supporting block 130.

The supporting block 135 includes an inner plate 70*c*, an outer plate 80*c* and a base plate 135. The rotary damper 55 is secured to the front end portion of the outer plate 80*c* by means of screws 45*c*, and is formed with a guide groove 85*c* . The inner plate 70*c* is formed with a rail 79*c*, and the guide groove 85*c* and rail 79*c* have an inverted trapezoidal cross section. The guide groove 85*c* and rail 79*c* extend in the fore-and-aft direction, and the rail 85*c* is inserted in the guide groove 85*c* as similar to those of the second embodiment. Therefore, the outer plate 80*c* is slidable on the rail 79*c*, and is secured to the inner plate 70*c* by means of screws 83*c*and 84*c*. The rail 79*c*, rear portion formed with the guide groove 85*c* and screws 83*c*/84*c* serve as a horizontal position adjuster 130*a*.

The inner plate 70*c* is further formed with a guide groove 136, and the guide groove 136 extends in the up-and-down direction. The base plate 135 is formed with a rail 137, and is secured to the side arm 113 by means of screws 138. The rail 137 extends in the up-and-down direction. The guide groove 136 and rail 137 have an inverted trapezoidal cross section, and the rail 137 is slidably received in the guide groove 136. The base plate 135 is secured to the side arm 113 by means of screws 138. For this reason, the inner plate 70*c* is slidable on the rail 137, and a worker moves the inner plate 70*c* and outer plate 80*c* to a proper position. When the inner plate 70*c* reaches the proper position, the worker drives a pair of bolts 138 into the inner plate 70*c*, and presses rail 137 to the inner surfaces defining the guide groove 136. As a result, the inner plate 70*c* is fixed to the proper position on the base plate 135. The periphery defining the guide groove 136, rail 137 and bolts 139 serve as a vertical position adjuster 130*b*.

As will be understood, the vertical position adjuster 130*b* and horizontal position adjuster 130*a* are incorporated in the supporting block 130, i.e., a part of the rotary connector CON4, and the worker properly and easily assembles the fallboard with the piano cabinet by virtue of the two position adjusters 130*a* and 130*b*.

Although particular embodiments of the present invention have been shown and described, it will be apparent to those skilled in the art that various changes and modifications may be made without departing from the spirit and scope of the present invention.

The pair of flat countersunk head woodscrews 58/63 and pair of truss head self-tapping screws 59 do not set any limit to the technical scope of the present invention. More than two flat countersunk head woodscrews 58/63 and more than two truss head self-tapping screws 59 may be used for each metal plate 50. The more than two screws 58/63/59 may enhance the resistance against the aged deterioration.

The head configuration, i.e., the flat countersunk head and truss head do not set any limit to the technical scope of the present invention. Washers achieves the advantage of the truss head and flat countersunk head.

The prepared holes 21 and 22 may be not formed in the side arms 13 in the preparation work. The flat countersunk head woodscrews 58 and truss head self-tapping screws 59 may be driven into the side arms 13 without any prepared holes.

The auxiliary holes 53 are available for the rotary connectors CON after the repairing work. In other words, the flat countersunk head woodscrews 63 may be driven into the side arms 13 after the repairing work. Otherwise, filler is injected into the main holes 21 and 22, or wood plugs are driven into the holes 21 and 22. After the solidification of filler or driving into the holes 21 and 22, the flat countersunk head woodscrews 58 and truss head self-tapping screws 59 are driven into the solidified filler or wood plugs.

The self-tapping screws 59 may not be driven into the side arms 13 under the condition that the woodscrews 58 or 63 are strong enough to achieve good durability.

If the self-tapping screws 59 keep the rotary connectors CON at the default positions, the main holes 51, prepared holes 21 and flat countersunk head woodscrews 58 are not necessary for the assembling work.

The present invention may appertain to a grand piano. In the grand piano, the rotary connectors CON are provided between a side board and a fallboard. The present invention may further appertain to other sorts of keyboard musical instruments such as, for example, a harpsichord, an organ, a celesta or a hybrid keyboard musical instrument. An automatic player piano and a mute piano are typical examples of the hybrid keyboard musical instrument.

The split type fallboard, i.e., the front fallboard hinged to the rear fallboard does not set any limit to the technical scope of the present invention. A fallboard may have a unitary structure made from a single board or a single mosaic board.

In the above-described embodiments, the two-dimensional position adjusters are provided between the rotary connectors CON/CON2/CON3 and the piano cabinets 100. However, this feature does not set any limit to the technical scope of the present invention. The two-dimensional position adjuster may be provided between the front metal plate 35 and the fallboard assembly UNT or between the rotary connector CON/CON2/CON3 and both of the fallboard UNT and piano cabinet 100.

The rotary damper may be replaced with a coil spring or another sort of elastic member. The coil spring exerts the elastic force on the fallboard in the direction from the closed position to the open position at all times. Otherwise, a liner damper may be provided between the slider 33 and the guide block 19. A cylinder having an inner space, a piston splitting the inner space into two chambers, a check valve provided on the piston and fluid may form the liner damper.

The rotary damper 55 is not any indispensable feature of the present invention. In case where a fallboard is light enough to be sustained by a player, the rotary damper 55 may be replaced with a standard bearing unit. The light fallboard is used in an electronic keyboard.

In case where the split-type fallboard is replaced with a single fallboard, the rotary damper or bearing unit may be provided between the piano cabinet and a single connecting plate, which is connected to the single fallboard.

The size of screws and holes do not set any limit to the technical scope of the present invention. The size of bolts and inner diameter of holes are mere examples.

The vertical position adjuster 73 may be implemented by jacks, each of which has both end potions pressed to the inner surface of the recess and the inner plate.

The horizontal position adjuster 81 may be implemented by a threaded rod, a nut connected to the outer plate and held in threaded engagement with the threaded rod and lock nuts.

The guide groove and rail may be formed in the inner plate 70*a* and outer plate 80, respectively.

The component parts of the first to fourth embodiments are correlated with claim languages as follows.

The fallboard assembly UNT is corresponding to a "cover plate", and the piano cabinet 100 serve as a "case of a musical instrument". The rotary connectors CON, CON2, CON3 and CON4 are corresponding to a "rotary connector". The cylinder 55*a*, bracket 57*a* and the rear metal plate 50 or supporting block 70/70A/130 as a whole constitute a "stationary portion", and the shaft 55*b*, front metal plate 35 form in combination a "rotatable portion". The peripheries of rear metal plate 50 defining the main and auxiliary holes 51/ 52/53, flat countersunk head woodscrews 58/63 and truss head self-adjusting screw 59 serve as a "position adjuster". The vertical position adjuster 73/ 130*b* and horizontal position adjuster 81/81A/130*a* also serve as the "position adjuster".

The white keys 41 and black keys 42 serve as an "array of manipulators", and the action units AC, dampers DM, hammers HM and strings ST as a whole constitute a "tone generating system".

The peripheries defining the holes 51 and 52, flat countersunk head wood screw 58 and truss head self-tapping screw 59 serve as a "main fastener", and the flat countersunk head woodscrew 63 and periphery defining the hole 53 serve as an "auxiliary fastener".

The vertical position adjuster 73 is an example of a "first position adjusting mechanism", and the horizontal position adjuster 81 is an example of a "second position adjusting mechanism".

The rotary damper 55 serves as a "damper". The front metal plate 35 and rear metal plate/supporting block 50/70 serve as a "connecting member" and another "connecting member", respectively. The inner plate 70*a* serves as a "first block", and the outer plate 80 serve as a "second block".

What is claimed is:

1. A rotary connector provided between a case of a musical instrument and a cover plate rotatable about an axis extending in a lateral direction of said case, comprising:

a stationary portion connected to one of said cover plate and said case;

a rotatable portion connected to the other of said cover plate and said case, and rotatable with respect to said stationary portion; and a position adjuster provided in association with one of said stationary portion and said rotatable portion, and permitting said one of said stationary portion and said rotatable portion to be moved to an optimum position on a virtual plane defined by an up-and-down direction and an fore-and-aft direction of said case, wherein said position adjuster has main fastener receptacles and fasteners fastening said one of said stationary portion and said rotatable portion to associated one of said case and said cover plate in an assemblage between said case and said cover plate so as to place said case and said cover plate in a position relative to each other and auxiliary fastener receptacles, offset from main fastener receptacles, and fasteners fastening said one of said stationary portion and said rotatable portion to said associated one of said case and said cover plate in a second offset placement assemblage after a movement on said virtual plane from the position determined in the first assemblage to a more optimum position when said first relative position is unsuitable, said auxiliary fastener remaining unused if said first relative position is suitable.

2. The rotary connector as set forth in claim 1, in which said main fasteners include a screw and a peripheral portion of said one of said stationary portion and said rotatable portion for defining a hole wider than a cross section of said screw so that said one of said stationary portion and said rotatable portion is two-dimensionally movable on said virtual plane.

3. The rotary connector as set forth in claim 2, in which said screw is a truss head self-tapping screw.

4. The rotary connector as set forth in claim 2, in which said main fasteners further include another screw and another peripheral portion of said one of said stationary portion and said rotatable portion as wide as a cross section of said another screw.

5. The rotary connector as set forth in claim 4, in which said another screw has a countersunk head, and said another peripheral portion has a conical inner surface to be tightly held in contact with said countersunk head.

6. The rotary connector as set forth in claim 1, in which said position adjuster has a first position adjusting mechanism permitting said one of said stationary portion and said rotatable portion to be moved in said up-and-down direction and a second position adjusting mechanism permitting said one of said stationary portion and said rotatable portion to be moved in said fore-and-aft direction.

7. The rotary connector as set forth in claim 6, in which said first position adjusting mechanism has female screws formed in said case and extending in said up-and-down direction, a female screw formed in said one of said stationary portion and said movable portion and aligned with said female screws, male screws held in threaded engagement with said female screws and said female screw and rotatable with respect to said one of said stationary portion and said movable portion so as to move said one of said stationary and movable portions in said up-and-down direction and lock nuts held in threaded engagement with said male screws and prohibiting said male screws from the rotation.

8. The rotary connector as set forth in claim 6, in which said second position adjusting mechanism includes a first block located at a proper position with respect to said case by means of said first position adjusting mechanism, a second block movably supported by said first block, a rail formed in one of said first and second blocks and extending in said fore-and-aft direction, a guide groove formed in the other of said first and second blocks, extending in said fore-and-aft direction and receiving said rail so as to permit said stationary and movable portions and said case to change relative position there between in said fore-and-aft direction, and a fastener provided in association with one of said first and second blocks and fixing said stationary portion and said movable portion to said optimum position.

9. The rotary connector as set forth in claim 8, in which said fastener has a periphery of said one of said first and second blocks defining a hole elongated in said fore-and-aft direction, a female screw formed in the other of said first and second blocks and a male screw passing through said hole and held in threaded engagement with said female screw so as to press said one of said first and second blocks to said other of said first and second blocks.

10. The rotary connector as set forth in claim 1, in which said position adjuster includes a damper for exerting resistance on said cover plate while said cover plate is being moved from an open position to a closed position, a connecting member connected between said damper and said cover plate and another connecting member connected between said damper and said case.

11. The rotary connector as set forth in claim 10, in which said damper has a cylinder having an inner space, a shaft inserted into said inner space and a damping mechanism provided in association with said shaft and generating said resistance.

12. The rotary connector as set forth in claim 11, in which said shaft is clamped between a movable finger and a stationary finger, and said movable portion has said movable finger and said stationary finger.

13. A musical instrument for producing tones, comprising:

a case having a fore-and-aft direction, a lateral direction and an up-and-down direction;

an array of manipulators arranged in said lateral direction for specifying a pitch of said tones, and mounted on said case;

a cover plate supported by said case for preventing said array of manipulators from damages, and rotatable about an axis extending in said lateral direction;

a tone generating system housed in said case, and connected to said array of manipulators for producing said tones; and rotary connectors provided between said case and said cover plate, and each including a stationary portion connected to one of said cover plate and said case, a rotatable portion connected to the other of said cover plate and said case and rotatable with respect to said stationary portion and a position adjuster provided in association with one of said stationary portion and said rotatable portion, and permitting said one of said stationary portion and said rotatable portion to be moved to an optimum position on a virtual plane defined by said up-and-down direction and said fore-and-aft direction, wherein said position adjuster has main fastener receptacles and fasteners fastening said one of said stationary portion and said rotatable portion to associated one of said case and said cover plate in an assemblage between said case and said cover plate so as to place said case and said cover plate in a position relative to each other and auxiliary fastener receptacles, offset from main fastener receptacles, and fasteners fastening said one of said stationary portion and said rotatable portion to said associated one of said case and said cover plate in a second offset placement assemblage after a movement on said virtual plane from the position determined in the first assemblage to said-a more optimum position when said first relative position is unsuitable, said auxiliary fastener remaining unused if said first relative position is suitable.

14. The keyboard musical instrument as set forth in claim 13, in which said array of manipulators is a keyboard having white keys connected to said tone generating system and black keys connected to said tone generating system.

15. The keyboard musical instrument as set forth in claim 14, in which said tone generating system includes action units respectively connected to said white and black keys, hammers linked with said action units and selectively driven for rotation when associated one or ones of said black and white keys are depressed and strings stretched in said case and opposed to said hammers so that said hammers are brought into collision therewith at the end of said rotation.

16. The keyboard musical instrument as set forth in claim 13, in which said cover plate has a rear board slidable on guide blocks of said case, and a front board rotatably connected to said case by means of said rotary connectors and hinged to said rear board so as to be folded over said rear portion when said array of manipulators are exposed to a player.

17. The keyboard musical instrument as set forth in claim 13, in which said position adjuster has a first position adjusting mechanism permitting said one of said stationary portion and said rotatable portion to be moved in said up-and-down direction and a second position adjusting mechanism permitting said one of said stationary portion and said rotatable portion to be moved in said fore-and-aft direction.

18. The keyboard musical instrument as set forth in claim 13, in which said position adjuster includes a damper for exerting resistance on said cover plate while said cover plate is being moved from an open position to a closed position, a connecting member connected between said damper and said stationary portion and another connecting member connected between said damper and said movable portion.

* * * * *